US009399879B2

(12) United States Patent
Burns et al.

(10) Patent No.: US 9,399,879 B2
(45) Date of Patent: Jul. 26, 2016

(54) VEHICLE COMPARTMENT DOOR HANDLE ASSEMBLY

(75) Inventors: Jayden F. Burns, Lime Springs, IA (US); Jennifer L. Bearman, New Hampton, IA (US); David L. Root, Tripoli, IA (US); David S. Magner, Decorah, IA (US); Chris J. Wildeboer, Dike, IA (US); Timothy J. Njus, Lawler, IA (US)

(73) Assignee: TriMark Corporation, New Hampton, IA (US)

( * ) Notice: Subject to any disclaimer, the term of this patent is extended or adjusted under 35 U.S.C. 154(b) by 666 days.

(21) Appl. No.: 13/097,748

(22) Filed: Apr. 29, 2011
(Under 37 CFR 1.47)

(65) Prior Publication Data

US 2012/0274457 A1 Nov. 1, 2012

(51) Int. Cl.
*E05B 3/00* (2006.01)
*E05B 41/00* (2006.01)
(Continued)

(52) U.S. Cl.
CPC . *E05B 41/00* (2013.01); *E05B 5/00* (2013.01); *E05B 77/44* (2013.01); *E05B 79/04* (2013.01);
(Continued)

(58) Field of Classification Search
CPC ... E05B 47/001; E05B 47/0012; E05B 47/06; E05B 47/0607; E05B 47/0611; E05B 47/0615; E05B 47/0619; E05B 47/0626; E05B 47/0634; E05B 81/04; E05B 81/06; E05B 81/16; E05B 81/64; E05B 81/66; E05B 81/68; E05B 7/00; E05B 2009/004; E05B 9/02; E05B 9/08; E05B 17/10; E05B 17/22; E05B 17/226; E05B 79/00; E05B 79/02; E05B 79/04; E05B 79/06; E05B 85/02; E05B 85/14; E05B 85/16; E05B 3/004; E05B 3/12; E05B 3/16; E05B 3/162; E05B 3/24; E05B 3/26; E05B 3/30; E05B 3/40; E05B 85/06; E05B 85/10; E05B 85/103; E05B 41/00; E05B 77/44; E05B 81/36; E05B 5/00; E05B 83/16
USPC ..... 292/DIG. 31, 97, 99, 100, 118, 123, 292/126, 194, 198, 200, 201, 213, 216, 217, 292/223, 226, 336.3, 341.15–341.17, 292/DIG. 38, DIG. 53, DIG. 64; 70/107–111, 70/208, 210, 256, 257, 275, 277, 278.7, 70/279.1, 283.1, 448, 449, 451, 466, 70/DIG. 15, DIG. 31, 370
See application file for complete search history.

(56) References Cited

U.S. PATENT DOCUMENTS 2,040,258 A * 5/1936 Jacobi ..... 70/370
2,610,500 A * 9/1952 Poupitch ..... 70/370
(Continued)

FOREIGN PATENT DOCUMENTS

DE 19948675 A1 * 6/2000
DE 19948677 A1 * 6/2000

OTHER PUBLICATIONS

Hansen International, www.hansenint.com, Electrified Latch brochure, 2 pages.

*Primary Examiner* — Alyson M Merlino
(74) *Attorney, Agent, or Firm* — McKee, Voorhees & Sease, PLC

(57) ABSTRACT

A handle assembly is provided for a door of a vehicle storage or baggage compartment and includes a latch module press fit onto the housing of the assembly. The handle assembly also includes a lock assembly with a security plate to preclude unauthorized manipulation of the lock arm. In one embodiment, a position switch is associated with the latch rotor to sense the unlatched position of the rotor. A remote control power unit may also be provided on the handle assembly for locking and unlocking the latch module via a key fob or other access system user interface. An LED may be associated with the power unit to indicate locking and unlocking events, or other vehicle status information. The mounting bracket of the assembly may be selected from interchangeable brackets for manual or power actuation of the lock assembly.

22 Claims, 20 Drawing Sheets

(51) Int. Cl.

| | |
|---|---|
| ***E05B 5/00*** | (2006.01) |
| ***E05B 77/44*** | (2014.01) |
| ***E05B 79/04*** | (2014.01) |
| ***E05B 81/06*** | (2014.01) |
| ***E05B 81/16*** | (2014.01) |
| ***E05B 81/36*** | (2014.01) |
| ***E05B 81/66*** | (2014.01) |
| ***E05B 83/16*** | (2014.01) |
| ***E05B 85/06*** | (2014.01) |
| ***E05B 85/18*** | (2014.01) |
| *E05B 13/10* | (2006.01) |

(52) U.S. Cl.

CPC ..... *E05B 81/06* (2013.01); *E05B 81/16* (2013.01); *E05B 81/36* (2013.01); *E05B 81/66* (2013.01); *E05B 83/16* (2013.01); *E05B 85/06* (2013.01); *E05B 85/18* (2013.01); *Y10T 70/5155* (2015.04); *Y10T 292/57* (2015.04)

(56) References Cited

U.S. PATENT DOCUMENTS

| | | | | | |
|---|---|---|---|---|---|
| 4,745,250 | A | * | 5/1988 | Mayo | 219/722 |
| 4,838,054 | A | * | 6/1989 | Weinerman et al. | 70/208 |
| 4,838,056 | A | * | 6/1989 | Weinerman et al. | 70/208 |
| 4,841,755 | A | * | 6/1989 | Weinerman et al. | 70/208 |
| 4,850,208 | A | * | 7/1989 | Weinerman et al. | 70/208 |
| 4,850,209 | A | * | 7/1989 | Weinerman et al. | 70/208 |
| 4,873,852 | A | * | 10/1989 | Neyret | 70/451 |
| 4,911,487 | A | * | 3/1990 | Rachocki | 292/216 |
| 4,969,916 | A | * | 11/1990 | Weinerman et al. | 70/208 |
| 5,042,853 | A | | 8/1991 | Gleason et al. | |
| 5,046,340 | A | * | 9/1991 | Weinerman et al. | 70/208 |
| 5,058,258 | A | * | 10/1991 | Harvey | 29/401.1 |
| 5,119,654 | A | * | 6/1992 | Ceron et al. | 70/369 |
| 5,123,691 | A | * | 6/1992 | Ginn | 296/37.1 |
| 5,127,686 | A | * | 7/1992 | Gleason et al. | 292/216 |
| 5,297,405 | A | * | 3/1994 | Manning et al. | 70/208 |
| 5,299,844 | A | | 4/1994 | Gleason | |
| 5,419,167 | A | * | 5/1995 | Yamada et al. | 70/208 |
| 5,439,260 | A | * | 8/1995 | Weinerman et al. | 292/48 |
| 5,484,178 | A | * | 1/1996 | Sandhu et al. | 292/173 |
| 5,493,881 | A | * | 2/1996 | Harvey | 70/277 |
| 5,564,295 | A | * | 10/1996 | Weinerman et al. | 70/208 |
| 5,586,458 | A | * | 12/1996 | Weinerman et al. | 70/208 |
| 5,606,882 | A | | 3/1997 | Larsen et al. | |
| 5,606,883 | A | * | 3/1997 | Svec | 70/370 |
| 5,611,224 | A | | 3/1997 | Weinerman et al. | |
| 5,689,980 | A | * | 11/1997 | Weinerman et al. | 70/208 |
| 5,884,948 | A | | 3/1999 | Weinerman et al. | |
| 5,941,104 | A | | 8/1999 | Sadler | |
| 5,974,842 | A | * | 11/1999 | Schlack et al. | 70/208 |
| 5,983,682 | A | * | 11/1999 | Parikh | 70/208 |
| 5,984,383 | A | * | 11/1999 | Parikh et al. | 292/121 |
| 6,116,067 | A | * | 9/2000 | Myers et al. | 70/279.1 |
| 6,393,882 | B1 | * | 5/2002 | Higgins | 70/370 |
| 6,454,321 | B1 | * | 9/2002 | Parikh | 292/216 |
| 6,513,353 | B1 | | 2/2003 | Weinerman et al. | |
| 6,543,821 | B1 | * | 4/2003 | Weinerman et al. | 292/123 |
| 6,595,033 | B1 | * | 7/2003 | Hara et al. | 70/370 |
| 6,604,393 | B2 | * | 8/2003 | Larsen et al. | 70/208 |
| 6,651,467 | B1 | | 11/2003 | Weinerman et al. | |
| 6,708,537 | B1 | * | 3/2004 | Eschweiler et al. | 70/208 |
| 6,805,388 | B1 | | 10/2004 | Lane | |
| 6,973,810 | B2 | * | 12/2005 | Chen | 70/208 |
| 7,010,946 | B2 | * | 3/2006 | Hahn | 70/111 |
| 7,232,162 | B2 | | 6/2007 | Pickar | |
| 7,234,329 | B2 | * | 6/2007 | Mazolf et al. | 70/277 |
| 7,333,021 | B2 | * | 2/2008 | Ieda et al. | 340/641 |
| 7,497,488 | B2 | * | 3/2009 | Chen | 292/216 |
| 7,611,173 | B2 | | 11/2009 | Helton et al. | |
| 7,681,424 | B2 | * | 3/2010 | Antonucci | 70/208 |
| 7,690,142 | B2 | * | 4/2010 | Pollack | 40/658 |
| 7,748,246 | B1 | * | 7/2010 | Paige et al. | 70/208 |
| 7,819,440 | B2 | | 10/2010 | Schwickerath | |
| 7,861,563 | B2 | * | 1/2011 | Antonucci | 70/208 |
| 8,146,394 | B2 | * | 4/2012 | Krueger | 70/279.1 |
| 8,186,191 | B2 | * | 5/2012 | Bacon | 70/208 |
| 8,347,667 | B2 | * | 1/2013 | Bacon | 70/107 |
| 8,393,187 | B2 | * | 3/2013 | Bacon | 70/107 |
| 9,127,477 | B1 | * | 9/2015 | Yang | E05B 17/10 |
| 2004/0017087 | A1 | * | 1/2004 | Ayres et al. | 292/165 |
| 2006/0001276 | A1 | * | 1/2006 | Vitry | B60R 5/04 292/216 |
| 2008/0157546 | A1 | * | 7/2008 | Vitry | E05B 5/00 292/226 |
| 2008/0258867 | A1 | * | 10/2008 | Harris et al. | 340/5.64 |
| 2010/0300162 | A1 | * | 12/2010 | Cappuccio et al. | 70/257 |

* cited by examiner

VEHICLE COMPARTMENT DOOR HANDLE ASSEMBLY

BACKGROUND OF THE INVENTION

Handle assemblies for vehicle compartment doors come in a variety of configurations and are mounted to the door in numerous manners. Some handle assemblies have limited options, such as power locking, but not other electronic or electromechanical features. Different problems exist for these prior art handles, such as corrosion, cycle life, finger clearance, security, handed requirements, assembly, installation, and interchangeability. Also, some handle assemblies are designed for high volume applications, but are not practical for low to medium volume applications, such as service truck bodies, RV motor homes, construction equipment, agricultural equipment and other trucks.

Accordingly, a primary objective of the present invention is the provision of an improved vehicle compartment door handle assembly which overcomes the problems associated with the prior art handle assemblies.

Another objective of the present invention is the provision of an improved vehicle and equipment door handle assembly having a latch module which is mounted to the housing quickly and easily.

Another objective of the present invention is the provision of a door handle assembly having a security plate between the housing and the lock assembly to preclude unauthorized or forced manipulation of the lock assembly for entry into the vehicle compartment.

A further objective of the present invention is the provision of an improved door handle assembly having a sensor or switch associated with the latch rotor to indicate the position or state of the rotor.

Still another objective of the present invention is the provision of an improved door handle assembly having power locking and unlocking integrated into the mounting bracket without the need for additional brackets and adjustments.

Yet another objective of the present invention is the provision of an improved door handle assembly having a snap in escutcheon for a key cylinder lock.

Another objective of the present invention is the provision of an improved door handle assembly having interchangeable mounting brackets to accommodate manual and power lock versions.

Still another objective of the present invention is the provision of a door handle assembly having LED lights to signal the unlatched position of rotor, e.g., the LED flashes several times if the door is open and the operator attempts to power lock the door.

Still another objective of the present invention is the provision of a door handle assembly having LED lights to indicate the locking and unlocking events for additional end user confirmation.

Another objective of the present invention is the provision of a door handle assembly having a mounting bracket which is retrofittable to an equivalent mechanical door system to convert the system to a keyless-entry power door system.

Yet another objective of the present invention is the provision of a door handle assembly having extra electro-mechanical features on the mount bracket.

Another objective of the present invention is the provision of a door handle assembly having multiple mount brackets which are adapted to fit multiple door hardware applications and different types of vehicles.

A further objective of the present invention is the provision of a door handle assembly having multiple mount brackets with selectable features to create various configurations for customized, specific vehicle installation preferences.

Another objective of the present invention is the provision of a door handle assembly that has easy installation, and is durable and secure in usage.

These and other objectives will become apparent from the following description of the invention.

SUMMARY OF THE INVENTION

The vehicle door handle assembly of the present invention is adapted to be installed on a vehicle door, such as compartment or storage compartments, for opening and closing the door relative to a frame surrounding the door. The handle assembly includes a front housing with a recessed well and a rear mounting bracket to which the front housing is mounted. An axle extends through the well of the housing, with a paddle pivotally mounted on the axle. A latch module is press fit on to the housing for retention on the housing and further secured by installing mount bracket. The latch module also secures the paddle axle to the housing.

The latch module includes a rotor, a catch, and an actuator arm. The paddle includes a leg extending through the housing so as to engage and pivot the actuator arm when the paddle is pulled, so as to rotate the catch to disengage the rotor and thereby release the spring biased rotor from the striker of the door frame for opening the door.

A lock assembly includes a housing with snap fit geometry to accept a lock cylinder escutcheon. The lock assembly includes a pivotal lock arm connected to the lock cylinder, with a security or anti-theft plate residing between the lock arm and the housing to preclude unauthorized manipulation of the lock arm. The latch rotor has a leg which engages an optional position switch in the mounting bracket to sense the position of the rotor. An optional reversible motor and actuator may be provided in the mounting bracket to control pivotal movement of the lock arm between locked and unlocked positions via a remote key fob or other access user interface. The mount bracket may also include one or more LEDs that flash in pre-determined method through lens of the housing to indicate a locked condition of the lock assembly and an unlocked condition of the lock assembly. The mounting bracket may be selected from first and second interchangeable brackets, with the first bracket including optional electronic features, such as LED indicators, door ajar rotor position switch, and the motor and actuator for remote power actuation of the lock assembly and the second bracket being adapted for manual actuation of the lock assembly.

DETAILED DESCRIPTION OF THE PREFERRED EMBODIMENTS

Figure 1:
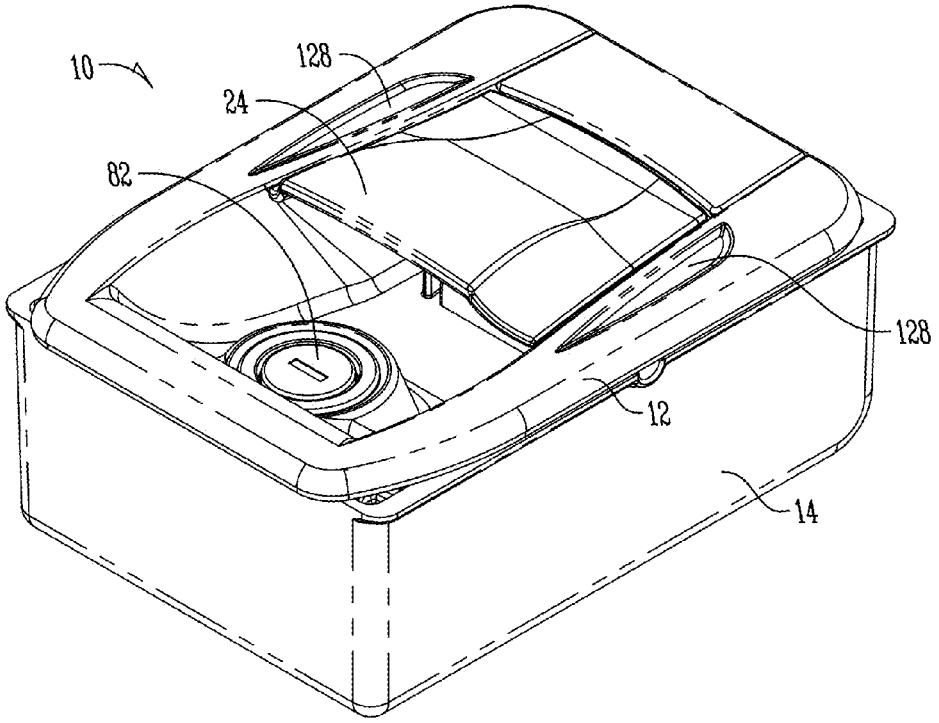
FIG. 1 is a perspective view of the handle assembly of the present invention.
Figure 2:
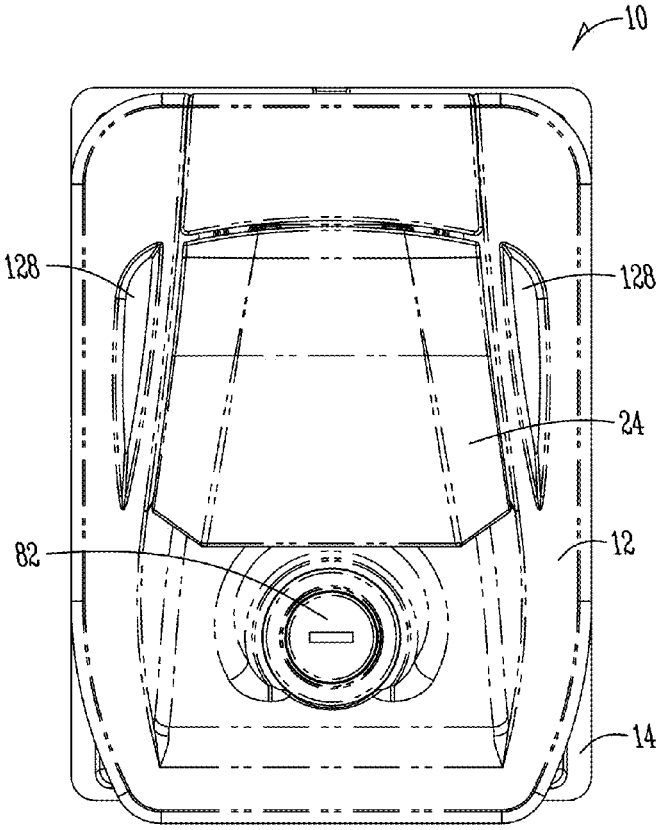
FIG. 2 is a top plan view of the assembly.
Figure 3:
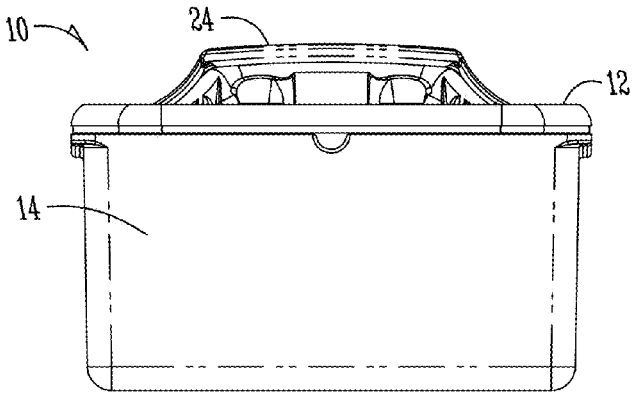
FIG. 3 is a front elevation view of the handle assembly.
Figure 4:
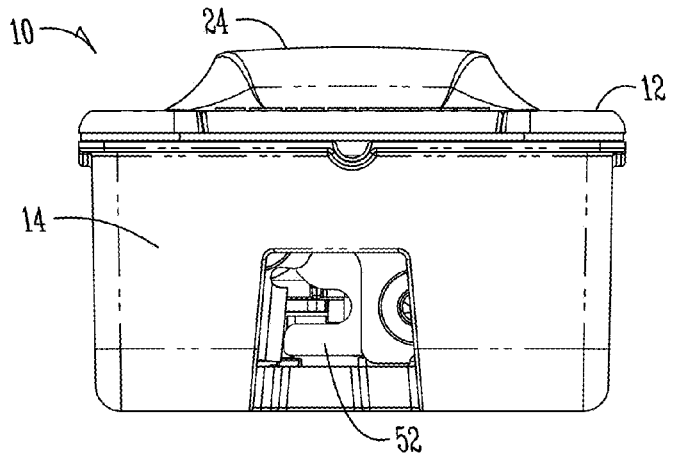
FIG. 4 is a rear elevation view of the handle assembly.
Figure 5:
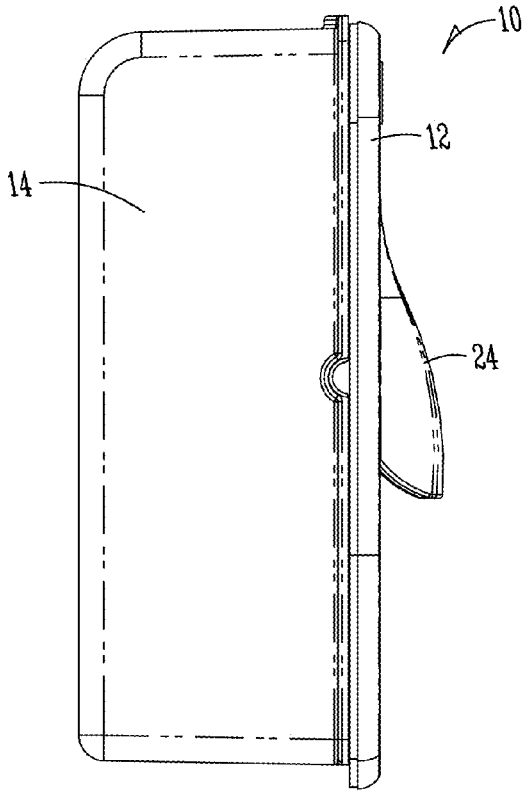
FIG. 5 is a side elevation view of the handle assembly, with the opposite side being a mirror image.
Figure 6:
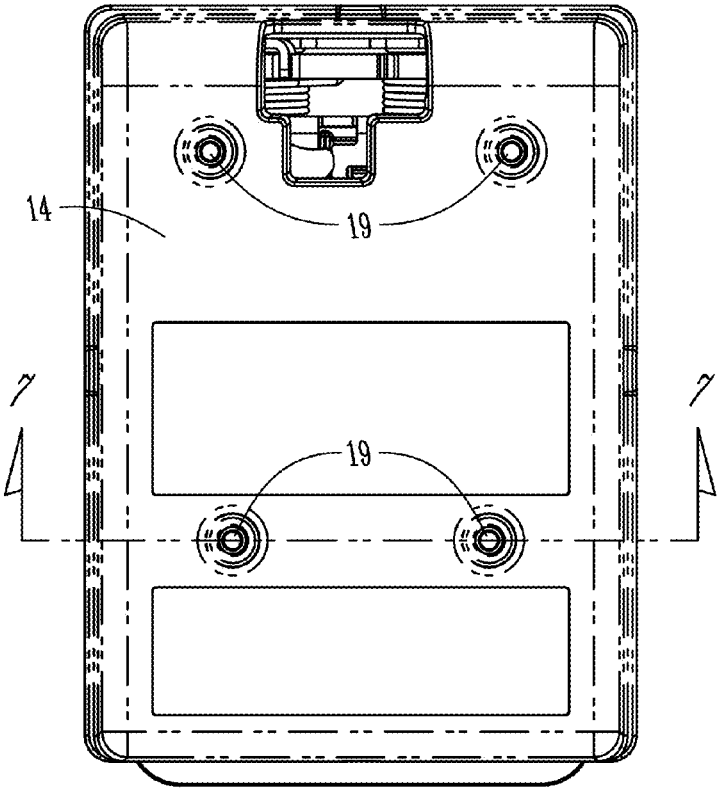
FIG. 6 is a bottom plan view of the handle assembly.
Figure 7:
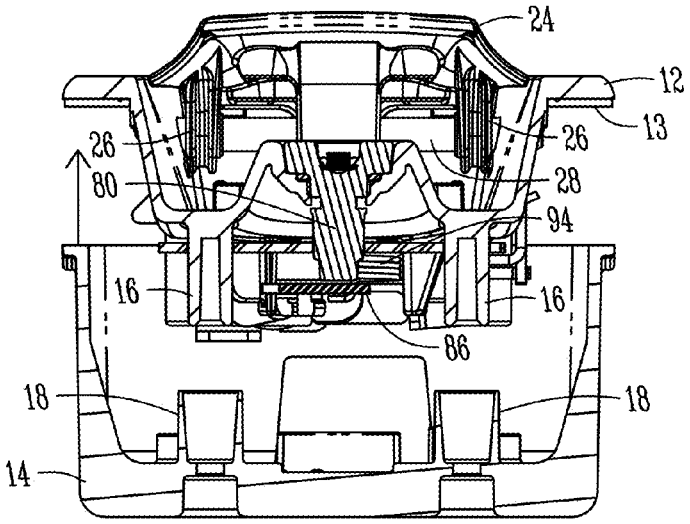
FIG. 7 is a sectional view taken along lines 7-7 of FIG. 6.
Figure 8:
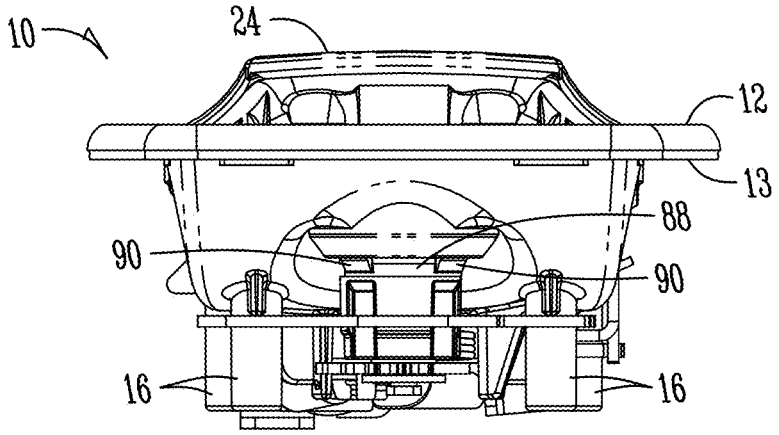
FIGS. 8 and 9 are end elevation views of the outer or front housing and associated structures for the handle assembly.
Figure 9:
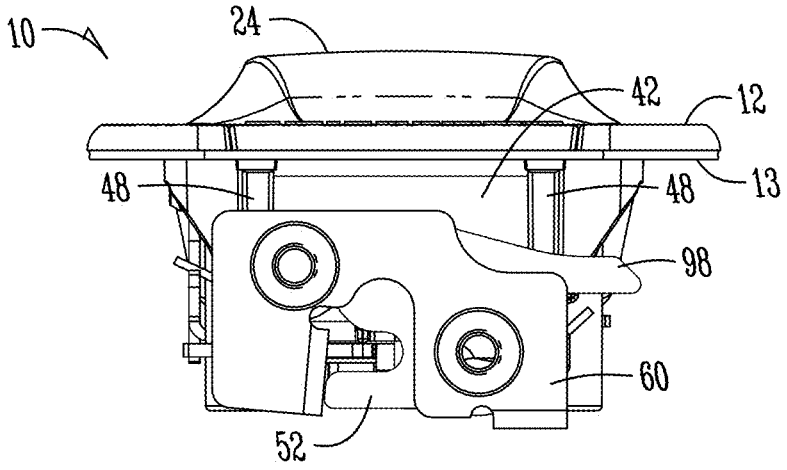
Figure 10:
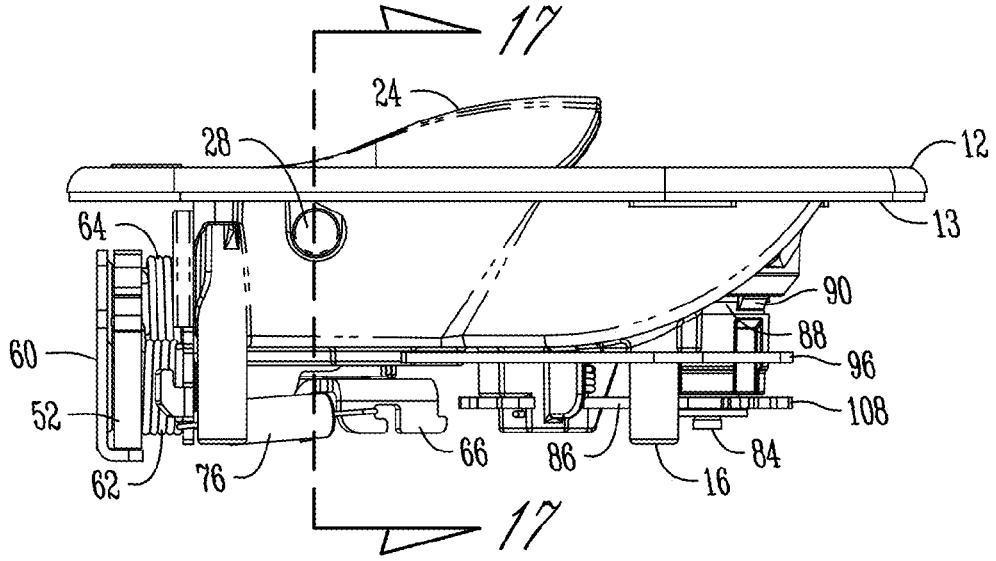
FIGS. 10 and 11 are side elevation views from opposite sides of the front housing.
Figure 11:
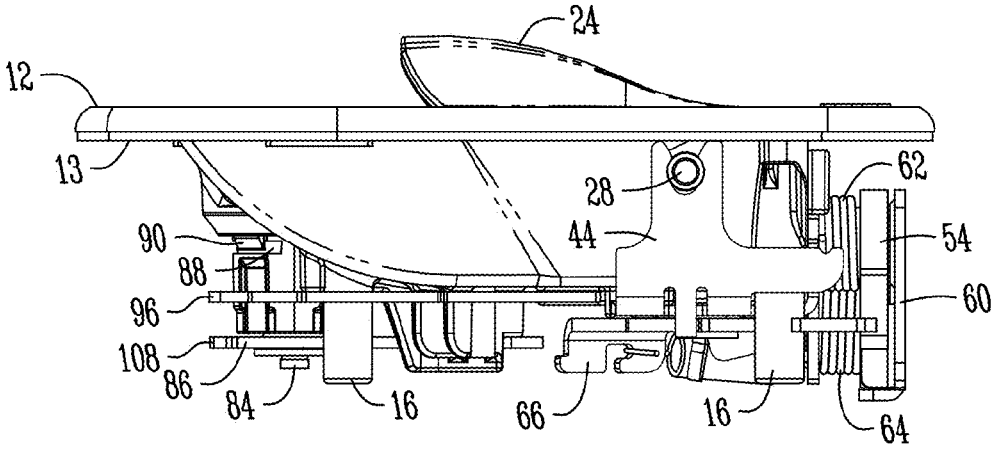
Figure 12:
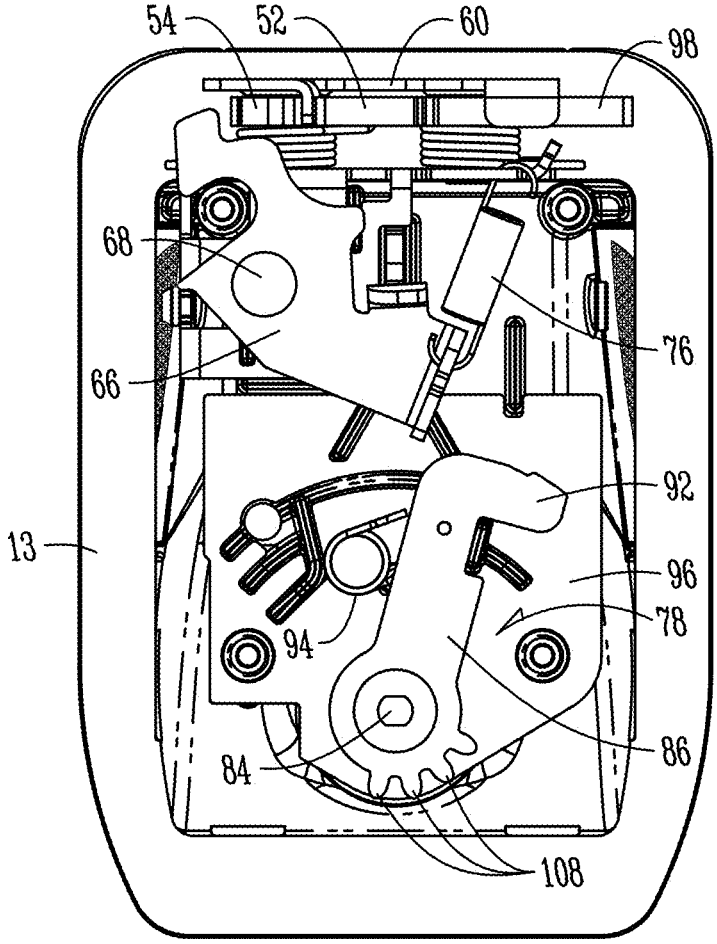
FIG. 12 is a rear elevation view of the front housing showing the lock assembly in an unlocked position.
Figure 13:
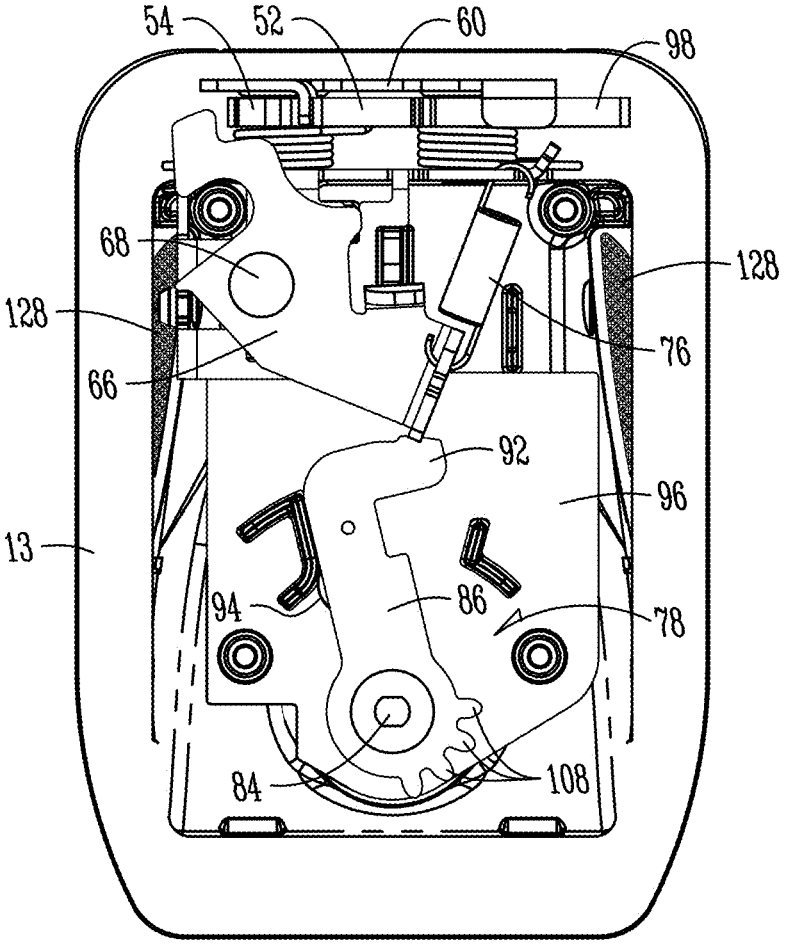
FIG. 13 is a rear elevation view of the front housing showing the lock assembly in a locked position.
Figure 14:
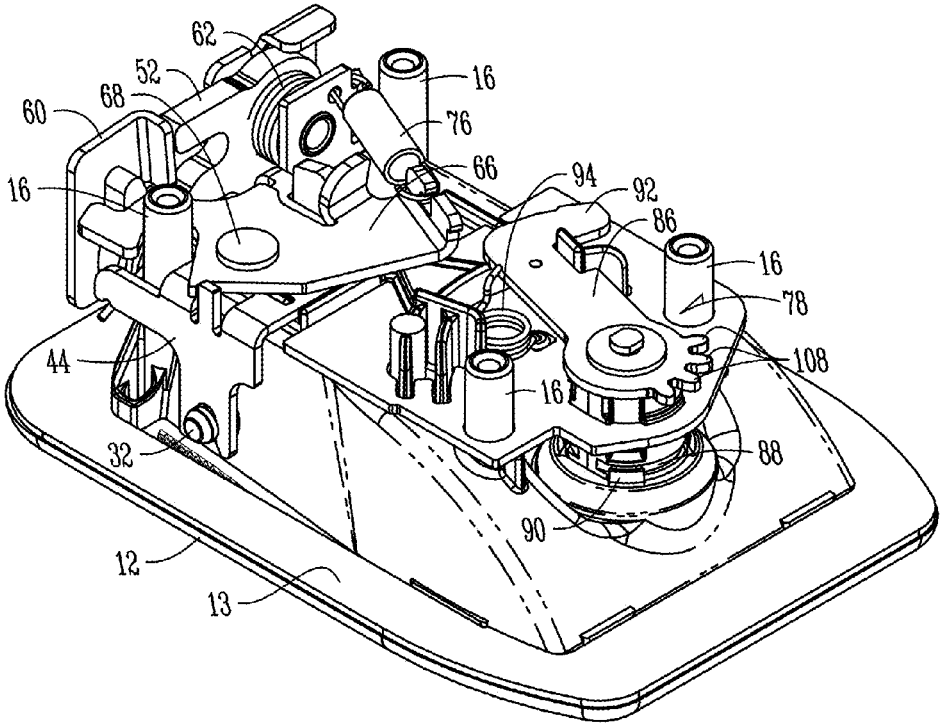
FIGS. 14 and 15 are perspective views from the rear of the front housing.
Figure 15:
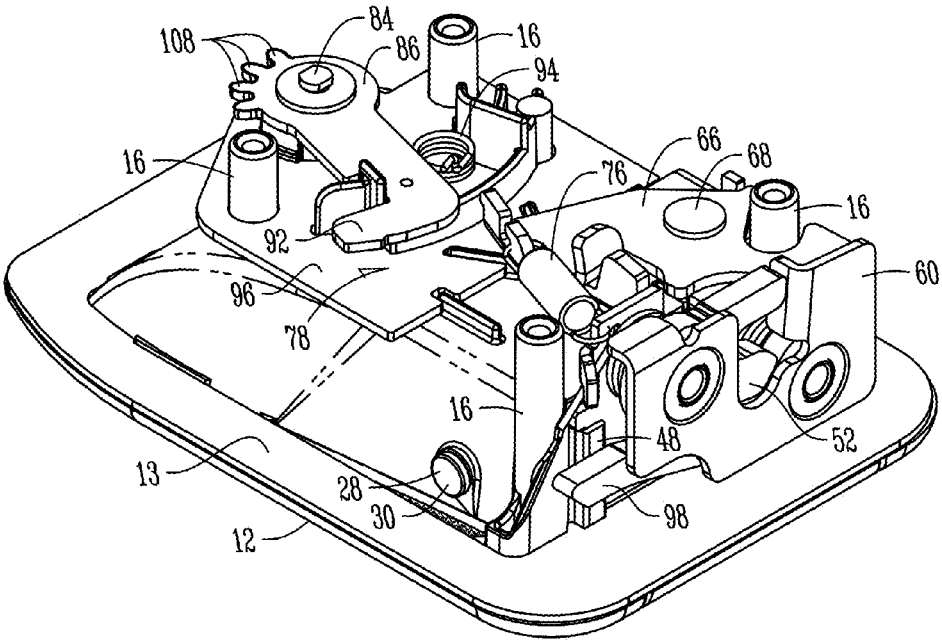
Figure 16:
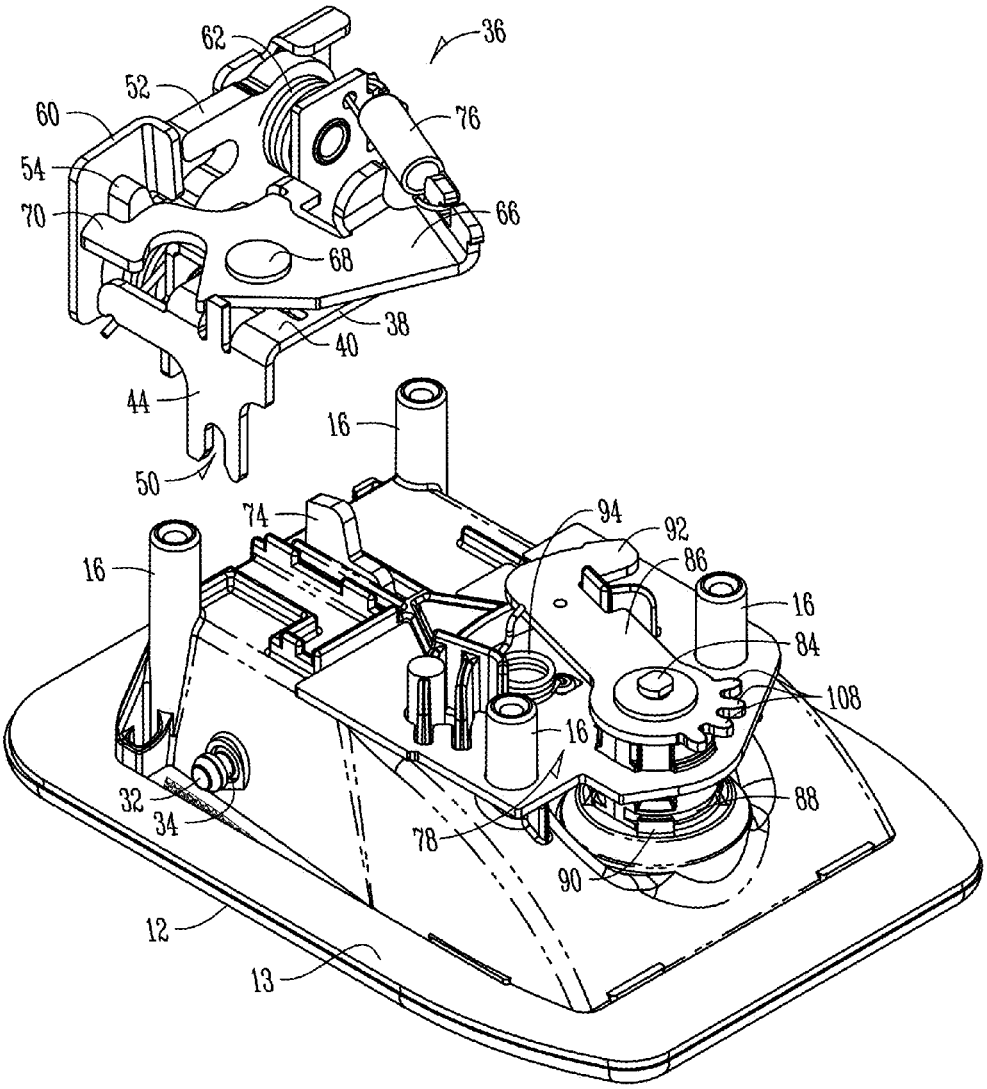
FIG. 16 is a partially exploded view of the front housing and a lock module.
Figure 17:
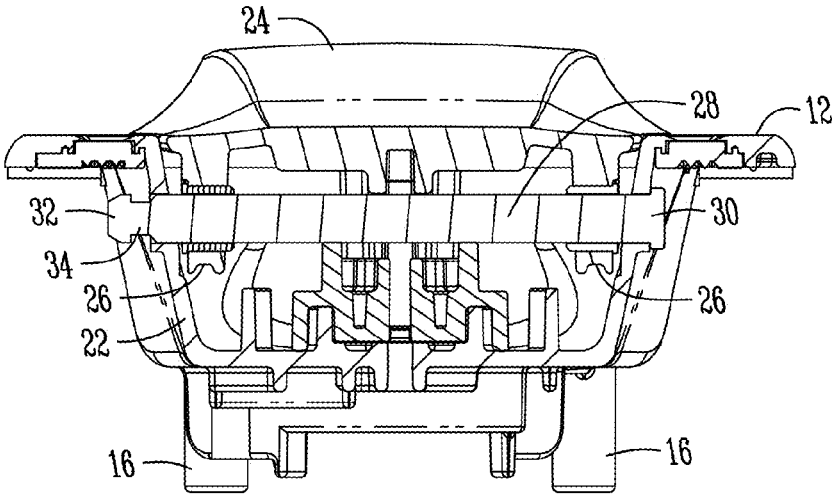
FIG. 17 is a sectional view taken along lines 17-17 of FIG. 10.

The handle assembly of the present invention is generally designated by the reference numeral 10 in the drawings. This handle assembly 10 is intended for use on compartment doors on various types of vehicles, such as service truck bodies, RV motor homes, agricultural equipment, construction equipment, and other trucks. The handle assembly 10 is mounted in the compartment door in any convenient manner. The handle assembly 10 generally includes a front or outer housing 12 and a rear mounting box or bracket 14. The front housing 12 has a plurality of rearwardly extending legs 16 which align with bosses 18. Screws (not shown) extend forwardly through counter bore holes 19 in the back wall 20 of the mounting bracket 14 for receipt in the legs 16, thereby securing the front or outer housing 12 to the mounting box or bracket 14. A sealing gasket 13 is provided between the housing 12 and the outer skin of the door to keep our moisture, dust and other contaminants.

Figure 18:
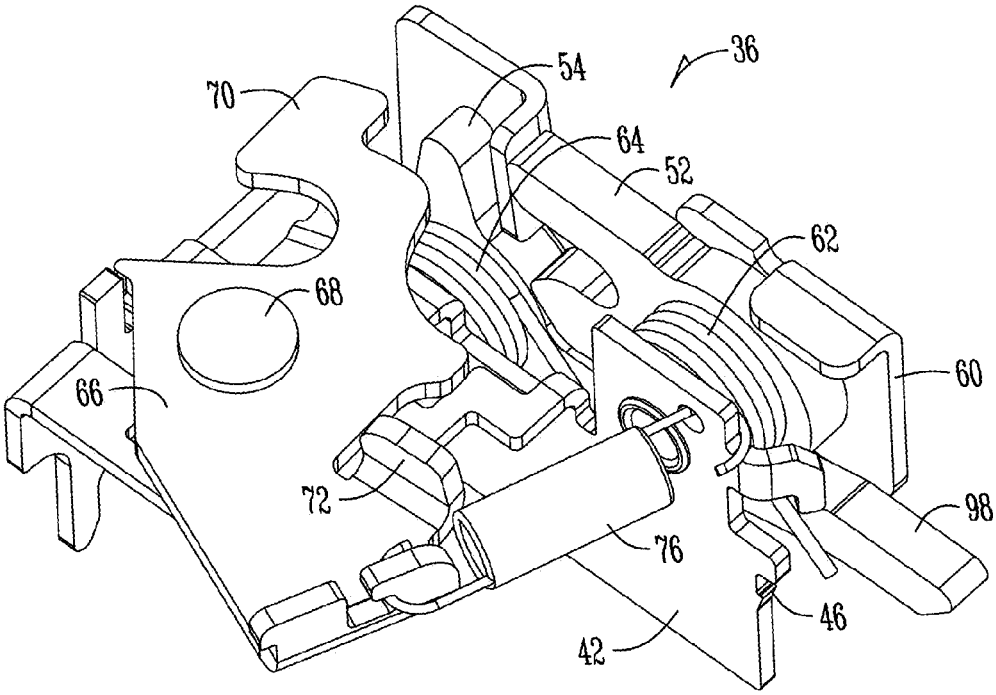
FIG. 18 is a perspective view of the latch module.
Figure 19:
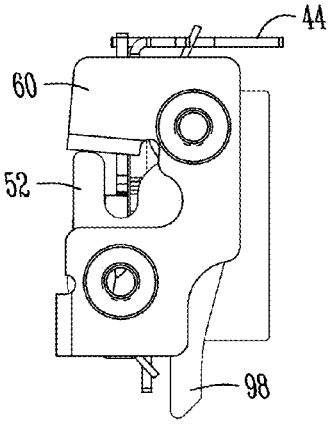
FIGS. 19 and 20 are end elevation views of the latch module taken from opposite ends, and with the rotor being in a closed or latched position.
Figure 20:
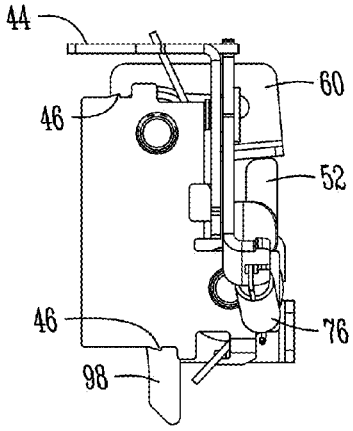
Figure 21:
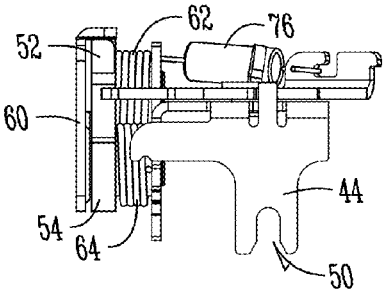
FIG. 21 is a side elevation view of the latch module, with the rotor being in a closed or latched position.
Figure 22:
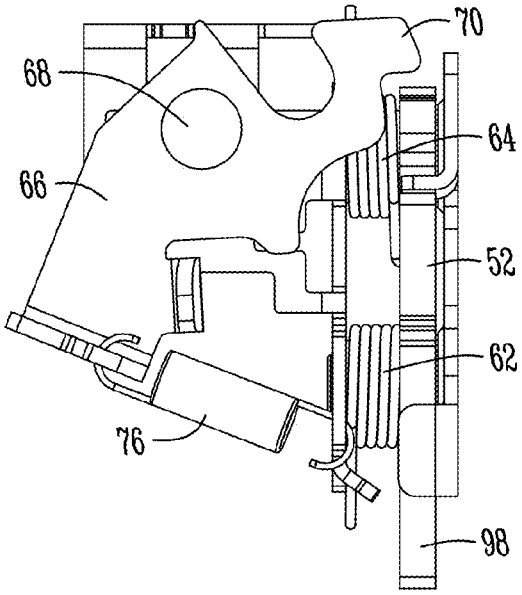
FIG. 22 is a rear plan view of the latch module.
Figure 23:
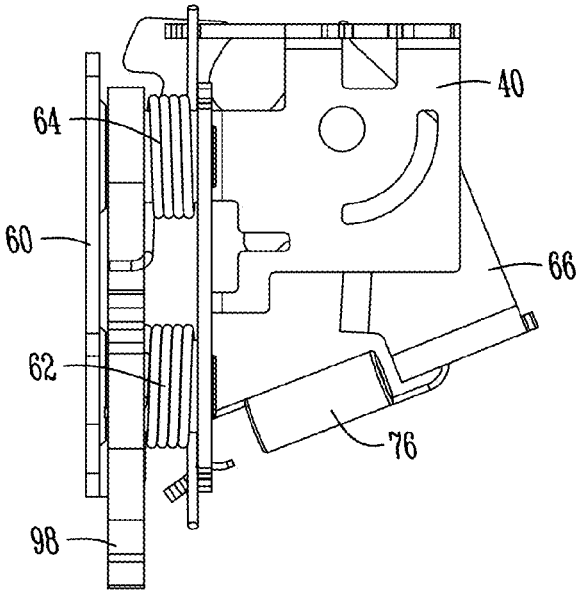
FIG. 23 is a front plan view of the latch module.

The housing 12 has a recess or well 22 in which an actuation paddle 24 is pivotally mounted. More particularly, the paddle 24 includes a pair of spaced apart legs 26 for receiving an elongated axle 28. The axle extends through opposite side walls of the well 22, as best seen in FIG. 18. One end of the axle 28 has an enlarged head 30, while the tail or opposite end 32 of the axle 28 has an annular slot 34.

The handle assembly 10 also includes a latch module 36 which is mounted to the front housing 12 as a single piece unit. The latch module 36 includes a mounting bracket 38 having a central body portion 40, a mounting flange 42, and an axle retention flange 44. The flanges 42, 44 extend substantially perpendicular to the upper body portion 40. The mounting flange 42 has opposite ends with barbs 46 which are adapted to be press fit into channels 48 on the back of the housing 12 for retaining the latch module 36 on the housing 12. The axle flange 44 includes a slot 50 to receive the annular groove 34 of the axle 28, and thereby retains the axle 38 in the housing 12.

Figure 25:
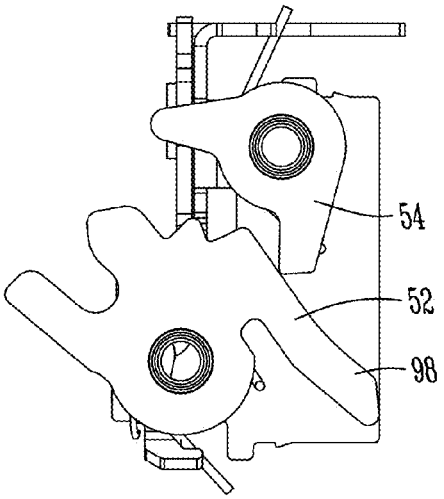
FIG. 25 is a view similar to 24 showing the rotor and catch in an unlatched condition.
Figure 26:
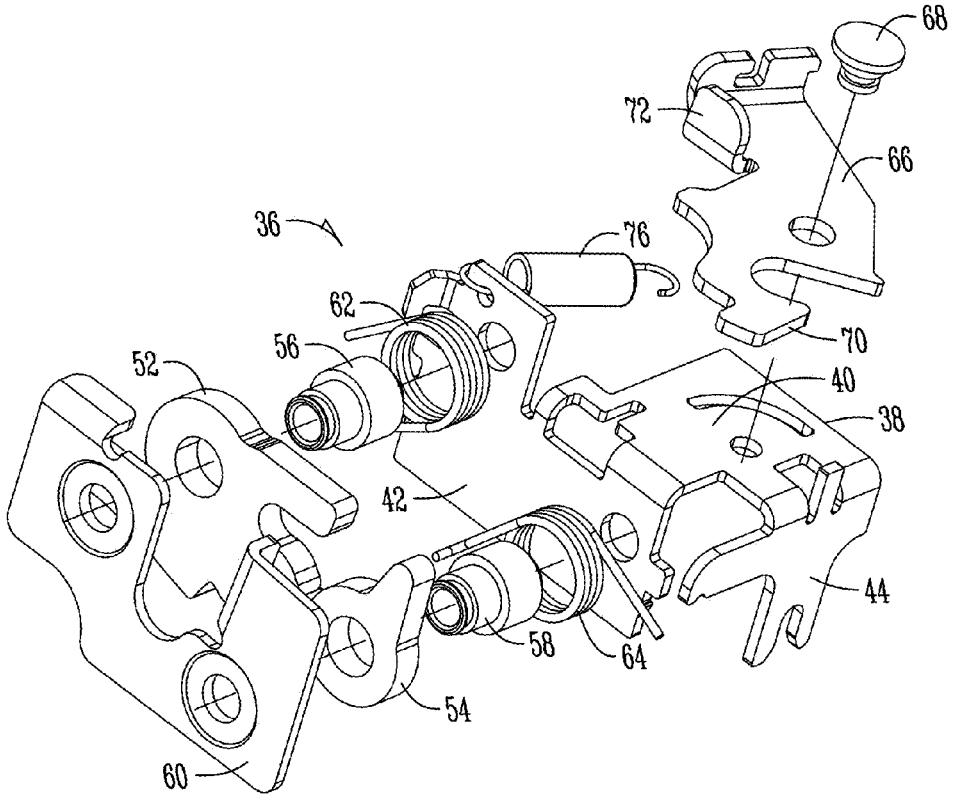
FIG. 26 is an exploded view of the latch module.
Figure 27:
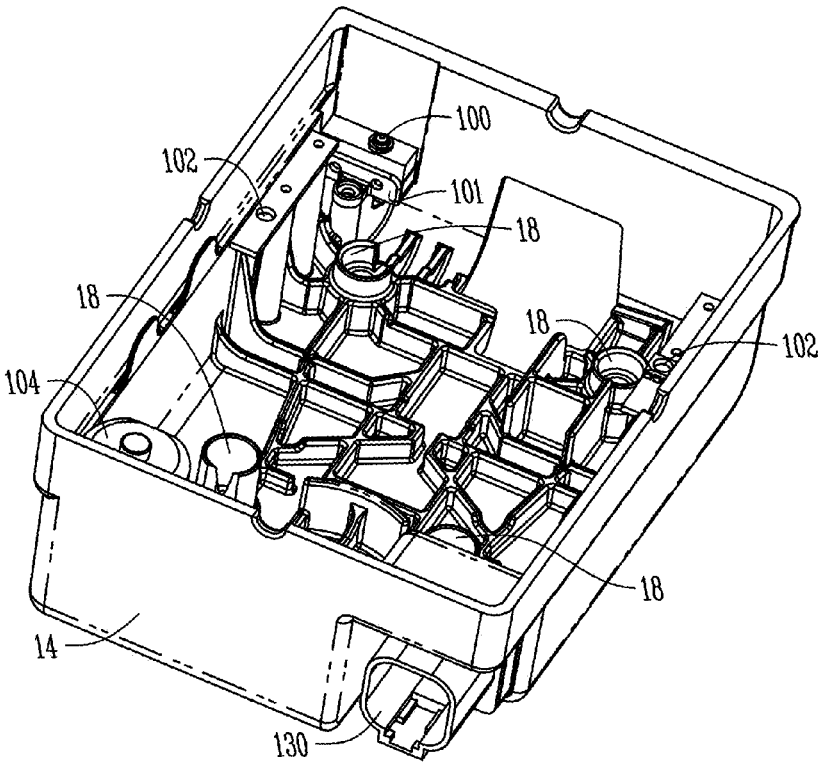
FIGS. 27-29 are perspective views of the mounting bracket according to one embodiment of the invention for remote control or power actuation of the lock mechanism.
Figure 28:
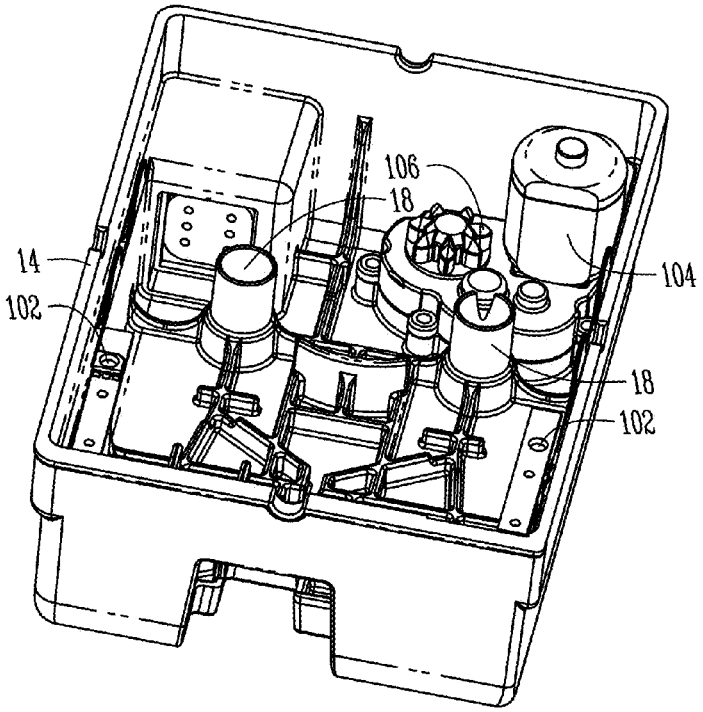
Figure 29:
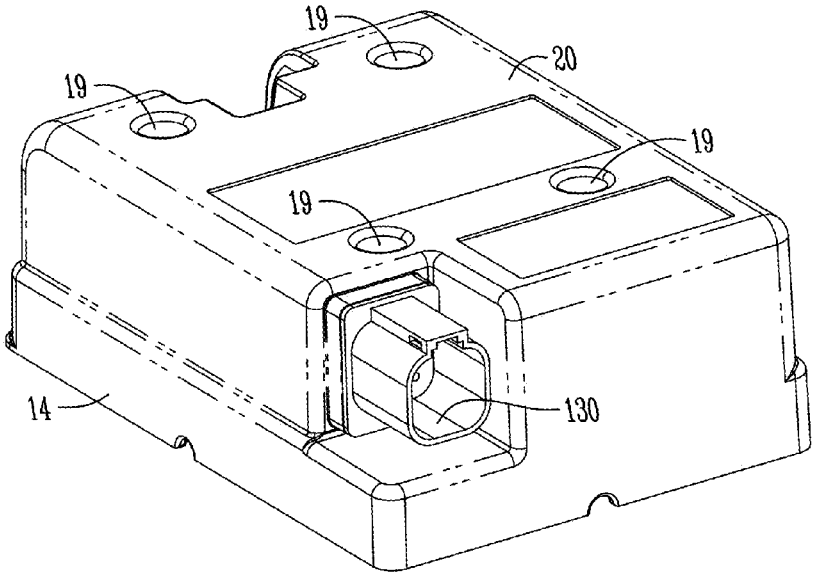
Figure 30:
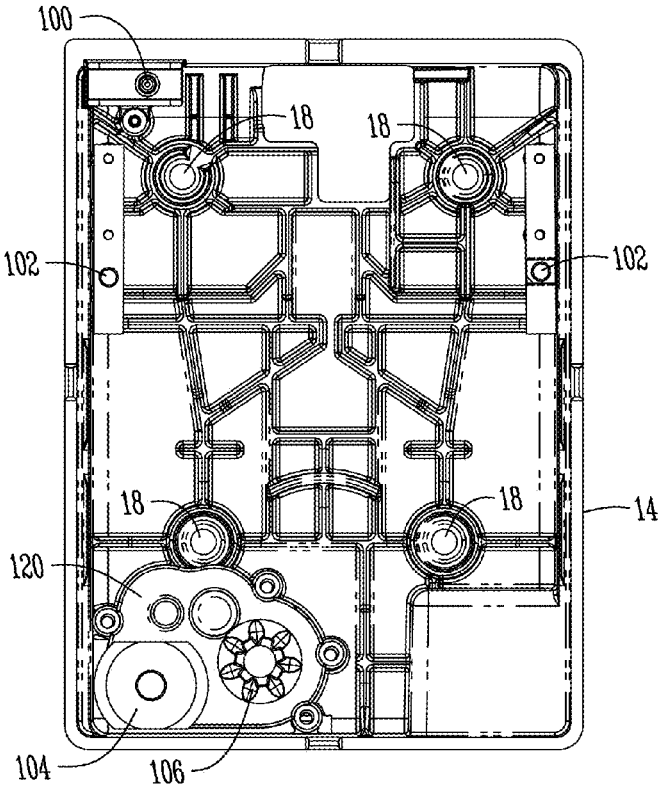
FIG. 30 is a plan view of the interior of the mounting bracket shown in FIGS. 27-34.
Figure 31:
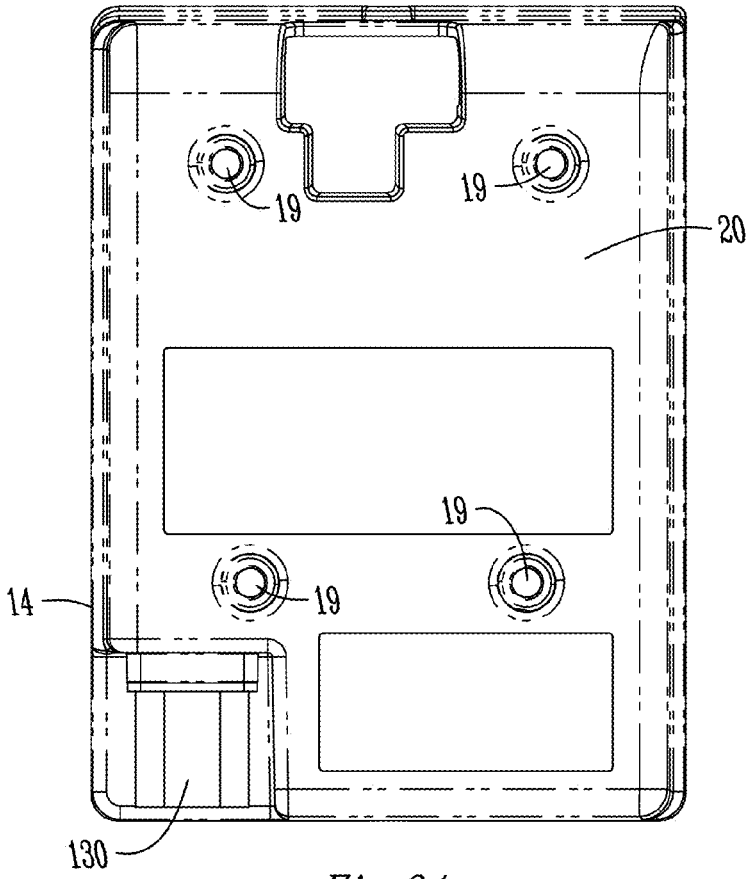
FIG. 31 is a bottom plan view of the mounting racket.
Figure 32:
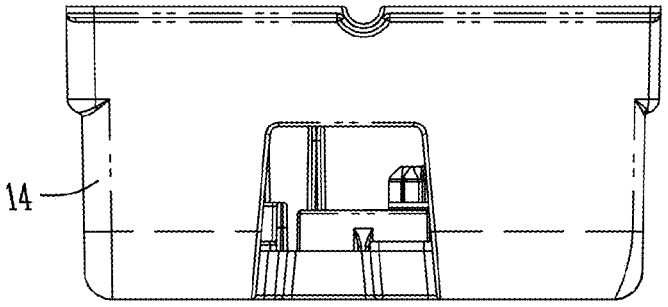
FIGS. 32 and 33 are end elevation views of the mounting bracket from opposite ends.
Figure 33:
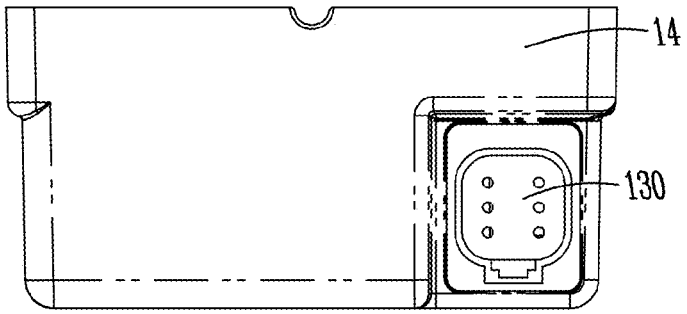
Figure 34:
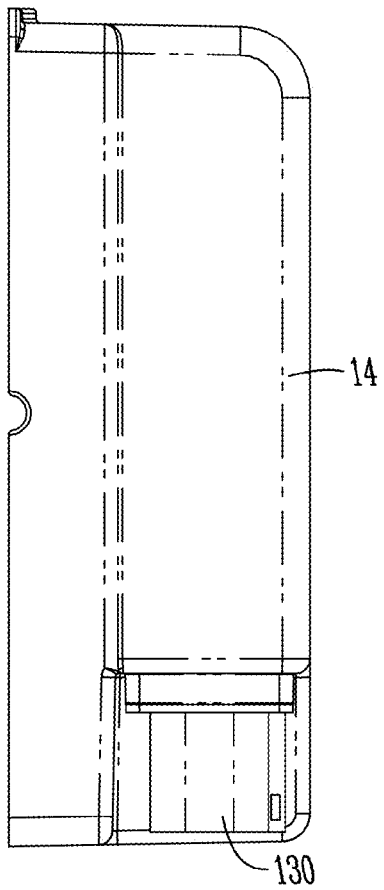
FIG. 34 is a side elevation view from one side of the mounting bracket.
Figure 35:
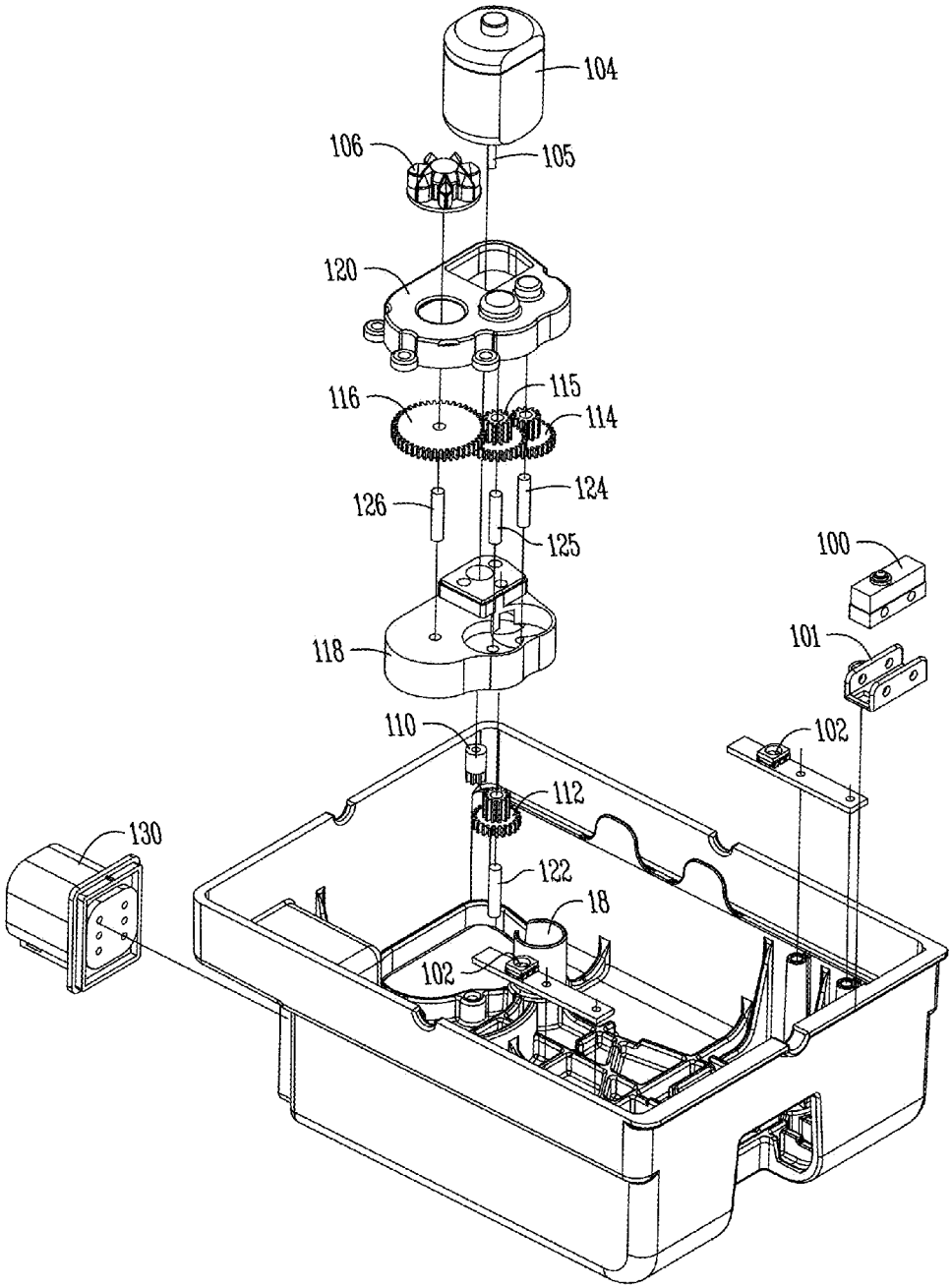
FIG. 35 is an exploded perspective view of the mounting racket and associated components.

The latch module 36 further includes a rotor 52 and a catch 54 which are pivotally mounted upon axles 56, 58, respectively. The axles 56, 58 are supported by a front plate 60. A pair of torsion springs 62, 64 are mounted on the axles 56, 58, respectively with one end of each spring being retained by the mounting bracket 38. The opposite ends of the springs 62, 64 engage the rotor 52 and the catch 54, respectively, so as to bias the rotor and the catch to an unlatched position, as shown in FIG. 25. The torsion spring 62 biases the rotor 52 to the unlatched position, while the torsion spring 64 biases the catch 54 to the latched position.

Figure 24:
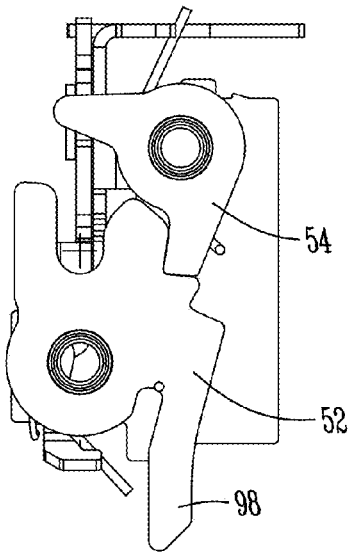
FIG. 24 is a view similar to FIG. 19 with the front plate removed to show the rotor and catch of the latch module in a latched condition.

The latch module 36 also includes an actuation plate or cam 66 pivotally mounted on the upper body portion 40 of the mounting bracket 38 via a rivet 68. The cam 66 includes a finger 70 for engaging the catch 54. The latch module 36 includes an extension spring 76 extending between the mounting flange 42 of the mounting bracket 38 and the cam 66 so as to bias the cam to a neutral position wherein the finger 70 is disengaged from the catch 54. The cam 66 also includes a flange 72 on the opposite side of the rivet 68 from the finger 70 which is adapted to be engaged by a leg 74 on the paddle 24 which extends through a slot in the front housing 12. When the paddle is pulled outwardly from the neutral or rest position, the leg 74 pushes the flange 72, thereby pivoting the cam 66 about the axis of the rivet 68, such that the finger 70 rotates the catch 54 to release the rotor 52, which then moves from the latched position shown in FIG. 24 to the unlatched position shown in FIG. 25 due to the bias of the spring 62.

The handle assembly includes a lock assembly 78. The lock assembly comprises an escutcheon 80 mounted in the front housing 12, a key cylinder 82 mounted in the escutcheon 80, an actuator 84 connected to the cylinder 82 on the rear or inner end of the escutcheon 80, and a lock arm or cam 86 mounted to the actuator 84. The escutcheon 80 includes an annular groove 88 for snap fit receipt of a plurality of tabs 90 on the housing 12, as shown in FIGS. 8, 10, 11 and 13.

The lock cam 86 is pivotal between a locked position and an unlocked position. When the cam 86 is in the unlocked position, the cam end 92 is spaced apart from the latch cam 66, such that the latch cam is free to pivot upon actuation of the paddle 24, thereby allowing the rotor 52 and catch 54 of the latch module 36 to move from the latched position to the unlatched position. When the lock arm 86 is pivoted to the lock position by actuation of the key cylinder 82 and actuator 84, the end 92 of the cam 86 engages the latch cam 66 to preclude movement of the cam 66, and thereby preclude the rotor 52 and catch 54 from opening from the latched position to the unlatched position.

A spring 94 biases the lock cam 86 toward the unlocked position.

The lock assembly 78 also includes a security or anti-theft plate 96 mounted on the back of the housing 12 so as to reside between the housing 12 and the lock cam 86. Preferably, the security plate 96 has holes through which the escutcheon 80 and housing legs 16 extend, as well as other structural components on the back of the housing 12.

The mounting bracket 14 of the handle assembly 10 may include several optional features which provide enhancements beyond the mounting function of the bracket 14. One option is a latch positioning sensor or switch 100 mounted on a support or holder 101 to the bracket 14 in a position adjacent the rotor 52. The rotor 52 includes an extension 98 which engages or activates the sensor 100 when the rotor is in the latched position, and disengages or deactivates the sensor 100 when the rotor 52 is in the unlatched position. The sensor 102 may be electrically coupled to one or more LEDs 102 mounted within the bracket 14 such that the LED is illuminated to indicate locking and unlocking of the handle assembly 10. The LED also provides indication when door is unlatched and power locking event occurs.

The bracket 14 may also be upgraded for powered operation of the latch module 36 by a remote key fob or other access system user interface. This upgrade includes a reversible electric motor 104 mounted inside the bracket 14. The motor output shaft 105 is operatively connected to a rotatable gear 106 in the bracket 14 by a series of gears 110, 112, 114, 115, and 116. The gears 114-116 are mounted between a spacer 118 and a dust cover 120. Shafts 122, 124, 125 and 126 rotatably support the gears 112-116, respectively. The gear 106 meshes with a plurality of teeth 108 on the lock cam 86. Thus, when a receiver connected to the motor 104 receives a signal from the remote transmitter, the motor 104 is actuated to rotate the gear 106, which in turn pivots the lock cam 86 to the locked or unlocked position. The motor 104 or receiver can be electrically coupled to the LEDs 102 mounted in the bracket 14, with the LEDs indicating when handle assembly 10 is locked and or unlocked. A lens 128 can be mounted in the front housing 12 above the LEDs 102 for a person to easily see the latched/unlatched and locked/unlocked condition of the handle assembly 10. A connector plug receiver 130 is ultrasonically welded to the bracket for receiving an electrical plug (not shown).

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A vehicle compartment door handle assembly for opening and closing a door relative to a door frame, the frame including a striker; the assembly comprising:

a front housing having a recessed well and a perimeter flange surrounding the well to define a perimeter edge of the front housing;

a rear box having a cavity in which the front housing is received so as to surround the well;

an axle extending through the recessed well;

a paddle pivotally mounted on the axle; and a latch module press fit on the front housing and within the perimeter edge, the latch module having a rotor movable between a latched position in which the rotor is engaged with the striker and an unlatched position in which the rotor is disengaged from the striker, wherein the rotor completely resides within the rear box when the rotor is in the latched position.

2. The handle assembly of claim 1 wherein the front housing includes opposing slots and the latch module includes opposing barbs for simultaneous press fitting into the slots.

3. The handle assembly of claim 1 wherein the latch module includes a leg with a slot for retentively engaging one end of the axle.

4. The handle assembly of claim 1 wherein the latch module includes an actuator arm, and wherein the paddle includes a leg extending through the front housing so as to pivot the actuator arm when the paddle is pulled and thereby allow the rotor to move from the latched position to the unlatched position.

5. The handle assembly of claim 4 further comprising a position switch adjacent the rotor to sense the position of the rotor.

6. The handle assembly of claim 1 further comprising a lock assembly on the front housing to lock the paddle against rotation and thereby preclude the door from being opened.

7. The handle assembly of claim 6 further comprising a power unit operatively connected to the lock assembly to remotely control the lock assembly.

8. A vehicle compartment door handle assembly for opening and closing a door relative to a door frame, the frame including a striker, the assembly comprising:

a front housing having front and rear sides, and having a perimeter flange defining a perimeter edge;

a rear mounting box having a cavity into which the front housing extends;

a paddle pivotally mounted on the front side of the front housing;

a latch module mounted on the rear side of the front housing and within the perimeter edge;

the latch module having a rotor movable between a latched position in which the rotor is engaged with the striker and an unlatched position in which the rotor is disengaged from the striker, wherein the rotor completely resides within the rear mounting box when the rotor is in the latched position, and wherein the rotor and catch latch and unlatch the door such that the handle assembly can open and close the door, a lock assembly mounted on the front housing and within the rear mounting box, with a key lock cylinder accessible from the front side and a pivotal lock arm connected to the lock cylinder on the rear side of the front housing; and a plate residing between the rear mounting box and the front housing to preclude unauthorized manipulation of the lock arm.

9. A vehicle compartment door handle assembly for opening and closing a door relative to a door frame, the frame including a striker, the assembly comprising:

a front housing having front and rear sides, and a perimeter flange defining a perimeter edge;

a rear box having a cavity for receiving the front housing and enclosing the rear side;

a paddle pivotally mounted on the front side of the front housing;

a latch module mounted on the rear side of the front housing and within the perimeter edge, the latch module having a rotor pivotally moveable between a latched position in which the rotor is engaged with the striker and an unlatched position in which the rotor is disengaged from the striker, wherein the rotor completely resides within the rear box when the rotor is in the latched position, a position switch adjacent the rotor to sense the position of the rotor; and an LED electrically coupled to the position switch to indicate the latched and unlatched status of the rotor indicating vehicle status information.

10. The handle assembly of claim 9 further comprising a lens mounted in the front housing over the LED.

11. A vehicle compartment door handle assembly for opening and closing a vehicle door relative to a vehicle door frame, the frame including a striker, the assembly comprising:

a front housing having front and rear sides, and a perimeter flange defining a perimeter edge;

a rear box having sidewalls and a closed back forming a cavity into which the front housing extends so as to enclose the rear side, the front housing and rear box being secured together;

a paddle pivotally mounted on the front side of the front housing;

a latch module mounted on the rear side of the front housing and within the perimeter edge;

the latch module having a rotor movable between a latched position in which the rotor is engaged with the striker and an unlatched position in which the rotor is disengaged from the striker, wherein the rotor completely resides within the rear box when the rotor is in the latched position a lock assembly mounted in the front housing and within the rear box, with a key lock cylinder accessible from the front side and a pivotal lock arm connected to the lock cylinder on the rear side of the front housing; and an actuator mounted on the rear box to control pivotal movement of the lock arm via a remote power unit.

12. The handle assembly of claim 11 further comprising a reversible electric motor mounted in the rear box to drive the actuator and thereby move the lock arm between locked and unlocked positions.

13. The handle assembly of claim 12 wherein the motor is electrically connected to an LED to indicate lock and unlock statuses of the handle assembly.

14. A vehicle compartment door handle assembly for opening and closing a door relative to a door frame, the frame including a striker, the assembly comprising:

a front housing having front and rear sides, and a perimeter flange defining a perimeter edge;

a rear box having sidewalls and a closed back forming a recess to receive the front housing and enclose the rear side;

a paddle pivotally mounted on the front side of the front housing;

a latch module mounted on the rear side of the front housing and within the perimeter edge;

the latch module having a rotor movable between a latched position in which the rotor is engaged with the striker and an unlatched position in which the rotor is disengaged from the striker, wherein the rotor completely resides within the rear box when the rotor is in the latched position, a lock assembly mounted on the front housing and within the rear box for being placed in locked and unlocked states; and an LED mounted in the rear box and being switchable to indicate the latched and unlatched states of the latch module and to indicate the locked and unlocked states of the lock assembly.

15. The handle assembly of claim 14 wherein the lock assembly includes a lock arm moveable between a locked position and an unlocked position relative to the latch module.

16. The handle assembly of claim 15 further comprising an actuator mounted in the rear box to control movement of the lock arm between the locked and unlocked positions.

17. A vehicle compartment door handle assembly for opening and closing a vehicle door relative to a vehicle door frame, the frame including a striker, the assembly comprising:

a front housing having front and rear sides, and a perimeter flange defining a perimeter edge, and having a hole with a plurality of perimeter tabs around the hole;

a rear box to which the front housing is secured to mount the handle assembly to the door, and the rear box surrounding the rear side of the front housing;

a paddle pivotally mounted on the front side of the front housing;

a latch module mounted on the rear side of the front housing and within the perimeter edge;

the latch module having a rotor movable between a latched position in which the rotor is engaged with the striker and an unlatched position in which the rotor is disengaged from the striker, wherein the rotor completely resides within the rear box when the rotor is in the latched position;

an escutcheon inserted into the hole of the front housing and having a single annular slot for snap fit receipt of the tabs so as to seat the escutcheon in the front housing; and a key cylinder in the escutcheon.

18. A vehicle compartment door handle assembly for opening and closing a vehicle door relative to a vehicle door frame, the frame including a striker, the assembly comprising:

a front housing having front and rear sides, and a perimeter flange defining a perimeter edge;

a rear box into which the front housing extends so that the rear side is housed within the rear box;

a paddle pivotally mounted on the front side of the front housing;

a latch module mounted on the rear side of the front housing and within the perimeter edge;

the latch module having a rotor movable between a latched position in which the rotor is engaged with the striker and an unlatched position in which the rotor is disengaged from the striker, wherein the rotor completely resides within the rear box when the rotor is in the latched position; and the rear box being selected from first and second interchangeable mounting boxes, wherein the first mounting box is adapted for remote power actuation of the lock assembly and the second mounting box is adapted for manual actuation of the lock assembly.

19. The handle assembly of claim 18 wherein the first mounting box includes a reversible electric motor.

20. The vehicle compartment door handle assembly of claim 8 wherein the plate resides between the front housing and the lock arm.

21. The vehicle compartment door handle assembly of claim 8 wherein the plate is separate from the rear mounting box.

22. The vehicle compartment door handle assembly of claim 11 wherein the actuator and the key lock cylinder are laterally offset from one another.

* * * * *